US006901688B1

(12) United States Patent
King

(10) Patent No.: US 6,901,688 B1
(45) Date of Patent: Jun. 7, 2005

(54) ILLUMINATED HOUSE ADDRESS SIGN

(76) Inventor: Thomas A. King, 626 W. Centre St., Mahanoy City, PA (US) 17948

( * ) Notice: Subject to any disclaimer, the term of this patent is extended or adjusted under 35 U.S.C. 154(b) by 0 days.

(21) Appl. No.: 10/805,425

(22) Filed: Mar. 22, 2004

(51) Int. Cl.[7] ..... G09F 13/04
(52) U.S. Cl. ..... 40/564; 440/465
(58) Field of Search ..... 40/564, 573–576, 40/581, 465

(56) References Cited

U.S. PATENT DOCUMENTS 1,525,021 A 2/1925 Benzenberg
1,657,967 A 1/1928 Kichline
2,296,893 A 9/1942 Austin
D254,298 S 2/1980 Sexton et al.
4,686,505 A 8/1987 Vanderburg
4,931,780 A 6/1990 LaMont et al.
4,993,058 A 2/1991 McMinn et al.
D353,549 S 12/1994 Gorman
5,911,524 A 6/1999 Wilton

*Primary Examiner*—Cassandra Davis
(74) *Attorney, Agent, or Firm*—Donald R. Schoonover

(57) ABSTRACT

A house address number sign includes a first light that is activated when the level of ambient light drops below a preset level, and a second light which is manually activated to provide an easily identified alert for emergencies or the like.

1 Claim, 1 Drawing Sheet

ILLUMINATED HOUSE ADDRESS SIGN

BACKGROUND OF THE INVENTION

1. Field of the Invention

The present invention relates to the general art of signs, and to the particular field of illuminated signs.

2. Discussion of the Related Art

House addresses may be difficult to read from a street. Nearly everyone has experienced the difficulty and annoyance of trying to find a particular address when house addresses were not readily visible. This is especially so in rural areas where houses may be set far back from a road or where addresses may be hidden behind bushes or the like.

While this is an annoyance in many situations, it can be dangerous and possibly life-threatening in an emergency situation. If a rescue vehicle has difficulty finding a particular house, valuable time may be lost while the vehicle searches for the house.

Therefore, there is a need for a house address sign that can be easily seen from the street.

The art contains several examples of house address signs that are illuminated to be more easily seen. However, many of these signs do not have sufficient illumination or proper illumination to be easily and quickly viewed and read from the street.

Therefore, there is a need for an illuminated house address sign that can be easily seen from the street.

The problems associated with viewing a house address, even an illuminated house address, are often exacerbated by light conditions. That is, at pre-dawn or at dusk for example, the light may be at such an angle that a driver on the street may not be able to easily see a house address, even if that address is illuminated.

Therefore, there is a need for an illuminated house address sign that can be easily seen from the street under a wide variety of light conditions.

PRINCIPAL OBJECTS OF THE INVENTION

It is a main object of the present invention to provide a house address sign that can be easily seen from the street.

It is another object of the present invention to provide an illuminated house address sign that can be easily seen from the street.

It is another object of the present invention to provide an illuminated house address sign that can be easily seen from the street under a wide variety of light conditions.

SUMMARY OF THE INVENTION

These, and other, objects are achieved by a house address sign that is illuminated by lights located on at least two sides of the house address numerals as well as being backlit. The backlighting is designed to be automatically actuated when ambient light falls below a certain level. The side-lighting is manually activated during an emergency or when special attention should be given to the house address numbers and/or their location. The side-lighting is used in addition to the backlighting. The side-lighting can be further emphasized by including a flasher element in the circuit used to connect the side lights to a power source.

Using the illuminated house address sign embodying the present invention will permit the house address to be easily and readily viewed from the street under a wide variety of lighting conditions. If the address sign is hidden from the street or road, a caller can simply tell someone to look for an amber sign and the exact house numbers need not be read as the amber sign will be readily visible and readily and easily identified. The address sign will stand out due to its colored light sources on either side of the house address, especially if those side lights are flashing.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in an illuminated house address sign 10.

Figure 3:
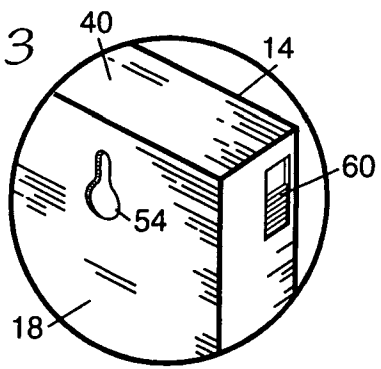
FIG. 3 is a detailed view showing a portion of the rear of the housing included in the illuminated house address sign embodying the present invention.
Figure 2:
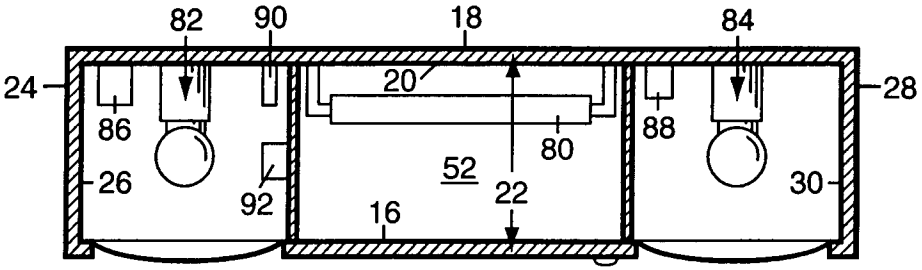
FIG. 2 is a view taken along line 2—2 of FIG. 1.
Figure 5:
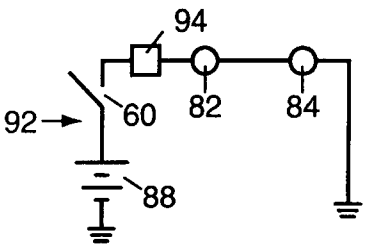
FIG. 5 is a circuit showing the electrical connection between two side light sources and a power source via a manual switch.
Figure 1:
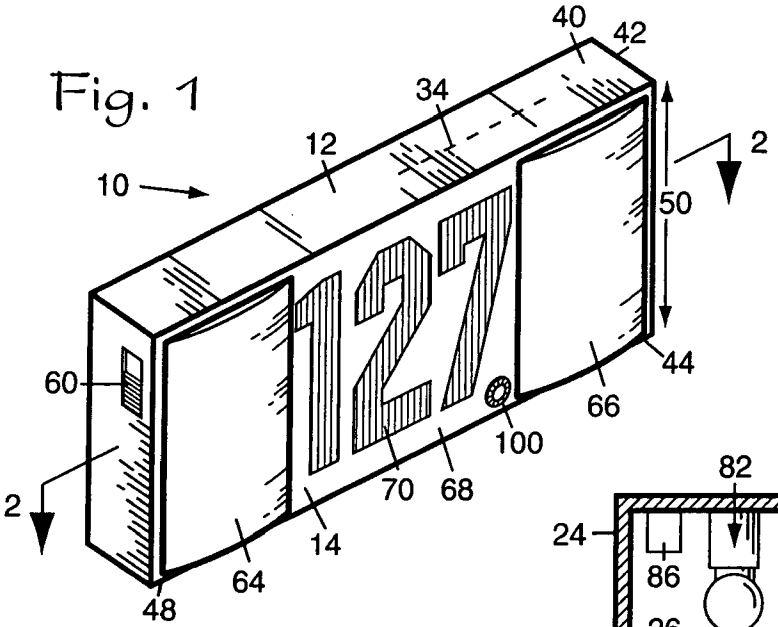
FIG. 1 is a perspective view of an illuminated house address sign embodying the present invention.

House address sign 10 comprises a hollow housing 12 which includes a first face 14 which is a front face when the housing 12 is in a use orientation as shown in FIG. 1. The first face 14 has an interior surface 16.

A second face 18 is a rear face when the housing 12 is in the use orientation. The second face 18 has an interior surface 20.

A thickness dimension 22 extends between the first face 14 and the second face 18.

The housing 12 further includes a first side edge 24 which has an interior surface 26, a second side edge 28 which has an interior surface 30, and a longitudinal dimension 34 which extends between the first side edge 24 and the second side edge 28.

The housing 12 further includes a first end edge 40 which is a top end edge when the housing 12 is in the use orientation shown in FIG. 1. The first end edge 40 has an interior surface 42.

A second end edge 44 of the housing 12 is a bottom end edge when the housing 12 is in the use orientation. The second end edge 44 has an interior surface 48.

A height dimension 50 of the housing 12 extends between the first end edge 40 and the second end edge 44.

An interior volume 52 of the housing 12 is defined by the interior surfaces of the first face 14, the second face 18, the first and second end edges 40, 44 and the first and second side edges 24, 28.

A support-accommodating hole 54 is defined through the second face 18 of the housing 12 near the first end edge 40 of the housing 12 and is used to mount the housing 12 in a convenient location so the sign 10 can be easily viewed from a street.

A manually operated on/off switch button 60 is located in the first side edge 24 of the housing 12 near the first end edge 40 of the housing 12.

A first translucent pane 64 is mounted on the housing 12 on the first face 14 of the housing 12 near the first side edge 24 of the housing 12, and the first translucent pane 64 is amber in color.

A second translucent pane 66 is mounted on the housing 12 on the first face 14 of the housing 12 near the second side edge 28 of the housing 12. The second translucent pane 66 is amber in color.

A translucent number-supporting pane 68 is mounted on the housing 12 on the first face 14 of the housing 12 and is located between the first translucent pane 64 and the second translucent pane 66. Indicia, such a house address number 70, are on the second translucent pane 68.

A flourescent light source 80 is mounted on the interior surface 20 of the second face 18 of the housing 12 adjacent to the number-supporting pane 68 to shine light on and through the number-supporting pane 68 when the flourescent light source 80 is activated. This will make the numbers on pane 68 visible at night or in low light conditions.

A first light source 82 is mounted on the interior surface 20 of the second face 18 of the housing 12 adjacent to the first translucent pane 64, and a second light source 84 is mounted on the interior surface 20 of the second face 18 of the housing 12 adjacent to the second translucent pane 66. When the first and second light sources 82, 84 are activated, the first and second translucent panes 64, 66 are illuminated and show amber colors on either side of the address number-supporting pane 68. This will call attention to the house address number sign 10.

A first power source, such as a battery 86 is located in the housing 12, and a second power source, such as a battery 88 is also located in the housing 12.

Figure 4:
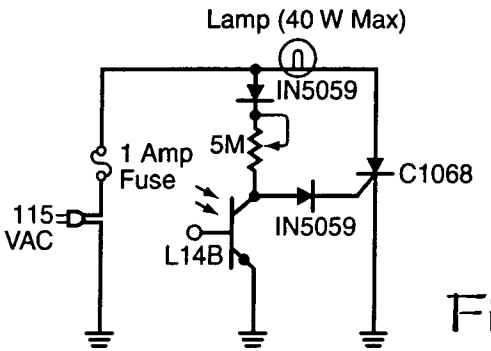
FIG. 4 is a circuit diagram that will automatically connect a fluorescent light to a power source to be activated when the level of ambient light drops below a preset limit.

An ambient light-activated switch circuit 90 electrically connects the flourescent light source 80 to first power source 86 when ambient light level drops below a preset level. One form of ambient light-activated switch circuit 90 is shown in FIG. 4. During daylight hours, the L14B photo-Darlington shunts all gate current to ground. At night, the L14B effectively provides a high resistance, diverting the current into the gate of the C106B thereby turning on the lamp 80. Other forms of the switch circuit can be used without departing from the scope of the present disclosure as will occur to those skilled in the art based on the teaching of this disclosure.

An activating circuit 92 electrically connects the first and second light sources 82, 84 to on/off switch 60 of the housing and to second power source 88 via the on/off switch 60 when the on/off switch 60 is in an "on" condition. The on/off switch 60 is normally in the "off" condition, but is moved into the "on" condition when special attention is desired for the address numbers on house sign 10, such as when an emergency vehicle has been called. A flasher element 94 can be included to cause lights 82 and 84 to flash when switch 60 is moved to the "on" position. This will make the house address sign 10 more noticeable.

A light sensor 100 is located on the translucent number supporting pane 68 and is part of circuit 92 to activate the fluorescent light 80 when ambient light drops below a preset level, such as at dusk, and to turn off the flourescent light 80 when ambient light level exceeds the preset level, such as at dawn.

It is understood that while certain forms of the present invention have been illustrated and described herein, it is not to be limited to the specific forms or arrangements of parts described and shown.

What is desired to be secured by Letters Patent is:

1. An illuminated house address sign comprising:

a) a hollow housing which includes
   (1) a first face which is a front face when said housing is in a use orientation, the first face having an interior surface,
   (2) a second face which is a rear face when said housing is in the use orientation, the second face having an interior surface,
   (3) a thickness dimension which extends between the first face and the second face,
   (4) a first side edge having an interior surface,
   (5) a second side edge having an interior surface,
   (6) a longitudinal dimension which extends between the first side edge and the second side edge,
   (7) a first end edge which is a top end edge when said housing is in the use orientation, the first end edge having an interior surface,
   (8) a second end edge which is a bottom end edge when said housing is in the use orientation, the second end edge having an interior surface,
   (9) a height dimension which extends between the first end edge and the second end edge,
   (10) an interior volume which is defined by the interior surfaces of the first face, the second face, the first and second end edges and the first and second side edges,
   (11) a support-accommodating hole defined through the second face of said housing near the first end edge of said housing, and
   (12) a manually operated on/off switch button located in the first side edge of said housing near the first end edge of said housing;

b) a first translucent pane on the first face of said housing near the first side edge of said housing, said first translucent pane being amber in color;

c) a second translucent pane on the first face of said housing near the second side edge of said housing, said second translucent pane being amber in color;

d) a translucent number-supporting pane on the first face of said housing and located between the first translucent pane and the second translucent pane;

e) a flourescent light source mounted on the interior surface of the second face of said housing adjacent to said number-supporting pane to shine light on said number-supporting pane when said flourescent light source is activated;

g) a first light source mounted on the interior surface of the second face of said housing adjacent to said first translucent pane;

h) a second light source mounted on the interior surface of the second face of said housing adjacent to said second translucent pane;

i) a first power source in said housing;

j) a second power source in said housing;

k) an ambient light-activated switch circuit electrically connecting said flourescent light source to said first power source when ambient light level drops below a preset level;

l) a light sensor located on said translucent number-supporting pane; and m) an activating circuit electrically connecting said first and second light sources to the on/off switch of said housing and to said second power source via said on/off switch when said on/off switch is in an on condition, said activating circuit including a flasher element.

* * * * *